US007889344B2

(12) United States Patent
Yamagishi

(10) Patent No.: US 7,889,344 B2
(45) Date of Patent: Feb. 15, 2011

(54) TRANSMITTED-LIGHT-INTENSITY MEASURING DEVICE, MEDIUM IDENTIFYING DEVICE, MEDIUM CONVEYING DEVICE, AND IMAGE FORMING APPARATUS

(75) Inventor: Masaru Yamagishi, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 93 days.

(21) Appl. No.: 12/453,233

(22) Filed: May 4, 2009

(65) Prior Publication Data

US 2009/0296093 A1 Dec. 3, 2009

(30) Foreign Application Priority Data

Jun. 3, 2008 (JP) ..... 2008-145826

(51) Int. Cl.
*G01N 21/00* (2006.01)

(52) U.S. Cl. ..... 356/432; 356/434

(58) Field of Classification Search ..... 356/432, 356/434

See application file for complete search history.

(56) References Cited

U.S. PATENT DOCUMENTS 6,393,252 B1 5/2002 Yamagishi
6,530,569 B2 3/2003 Yamagishi
6,690,911 B2 2/2004 Yamagishi
7,516,955 B2 4/2009 Yamagishi
2007/0115463 A1* 5/2007 Dureiko ..... 356/239.1
2009/0051101 A1 2/2009 Yamagishi

FOREIGN PATENT DOCUMENTS

JP 2002-311753 10/2002
JP 2003-029581 1/2003
JP 2003-101720 4/2003
JP 2006-321215 11/2006

* cited by examiner

*Primary Examiner*—Roy Punnoose
(74) *Attorney, Agent, or Firm*—Harness, Dickey & Pierce, P.L.C.

(57) ABSTRACT

A device for measuring intensity of a transmitted light, includes a first measuring unit that measures a first intensity of a light transmitted through a medium on a conveying path in its thickness direction and outputs a first measured value; a second measuring unit that is arranged adjacent to the first measuring unit, measures a second intensity of the light transmitted through the medium in the thickness direction, and outputs a second measured value; and an operating unit that obtains a true measured value from the first measured value and the second measured value.

16 Claims, 10 Drawing Sheets

TRANSMITTED-LIGHT-INTENSITY MEASURING DEVICE, MEDIUM IDENTIFYING DEVICE, MEDIUM CONVEYING DEVICE, AND IMAGE FORMING APPARATUS

CROSS-REFERENCE TO RELATED APPLICATIONS

The present application claims priority to and incorporates by reference the entire contents of Japanese priority document 2008-145826 filed in Japan on Jun. 3, 2008.

BACKGROUND OF THE INVENTION

1. Field of the Invention

The present invention relates to a technology for identifying a type of a medium being conveyed and detecting multiple feed of the medium in an image forming apparatus.

2. Description of the Related Art

A medium identifying device that includes a transmitted-light-intensity measuring unit and identifies a type of a medium (hereinafter, "medium type") such as a paper sheet on a conveying path or detects multiple feed (i.e., conveying two or more overlapped media at one time) is generally used in a feeding device that feeds a medium. The feeding device picks up one medium from a stack of media that is stacked in a stacking unit, and feeds the medium to a predetermined area. For example, the medium identifying device is used in a sheet feeding device of an image forming apparatus, such as a copier and a printer, a feeding device of an original conveying device, and an original feeding device of a scanner.

The medium type is determined in the feeding device because an optimum condition for copying, printing, original reading, or the like differs depending on the medium type. The medium type can be determined by a user manually inputting the medium type or by automatically identifying the medium type.

When the medium type is determined manually by the user, the user may input incorrect information, causing "incorrect setting of medium information" or "incorrect setting of media in a tray". If such an operational error occurs, a medium may be used that is not corresponding to a medium setting recognized by the feeding device. As a result, an image quality may be degraded due to poor fixability of an image on the medium or use of incorrect transfer conditions, a paper jam may occur, and other various problems may occur. To solve the above problem, for example, Japanese Patent Application Laid-open No. 2003-29581 discloses a technology for combining the manual input of the medium type by a user and the automatic identification of the medium type. Various similar technologies are disclosed in, for example, Japanese Patent Application Laid-open No. 2002-311753 and Japanese Patent Application Laid-open No. 2003-101720.

Japanese Patent Application Laid-open No. 2006-321215 discloses a transmitted-light-intensity measuring unit including a light emitting unit 110 and a light receiving unit 111 that are arranged as shown in FIG. 2 because an angle of guide plates 130*a* and 130*b* and an angle of a medium 114 to be inserted to a nip between registration rollers is designed so that the medium 114 is always deflected in approximately the same manner.

The feeding device needs to detect the multiple feed because of the following reason. When the multiple feed occurs during, for example, an image forming process, overlapped media may be separated from one another on a conveying path, and the separated medium may be wound on a transferring unit, a fixing unit, or the like, resulting in damaging the feeding device. Even if the overlapped media are discharged without being separated, a user needs to check whether there are the overlapped media in a stack of discharged media on which images are formed, which is cumbersome. Such an operation becomes more cumbersome especially when the stack of media is stapled. To prevent this, it is needed to suspend the operation such as an image forming operation and notify a user of the occurrence of the multiple feed immediately after the multiple feed occurs. For controlling such suspension or notification, the multiple feed needs to be detected. It is known that the multiple feed can be detected based on a reflected light intensity or a transmitted light intensity measured from or through a medium.

An operation of a conventional medium identifying device is described below with reference to FIGS. 1A and 1B. FIG. 1A is a schematic diagram illustrating a state where a thin sheet medium is conveyed to a transmitted-light-intensity measuring unit from a bypass tray and a sheet feeding device. FIG. 1B is a schematic diagram illustrating a state where a thick sheet medium is conveyed to the transmitted-light-intensity measuring unit from the bypass tray and the sheet feeding device.

As shown in FIG. 1A, a leading edge of a medium being conveyed abuts a pair of registration rollers 23 that are stopped, so that the medium is suspended in a state of being deflected. At this state, a deflected shape of the medium (the amount of deflection) is controlled to a predetermined shape by the upper guide plate 130*a* arranged upstream of the registration rollers 23. Then, a transmitted light intensity of the medium is measured while the medium is deflected. The light-intensity measuring unit (light emitting unit) 110 and the light-intensity measuring unit (light receiving unit) 111 are arranged at positions where the deflected shape of the medium is controlled by the upper guide plate 130*a*, so that a constant distance can be maintained from the medium to each of the light emitting unit 110 and the light receiving unit 111. As a result, the transmitted light intensity can be measured more accurately. Besides, the transmitted light intensity is measured while the medium is suspended, that is, the deflected shape of the medium is stably maintained during measurement, so that fluctuation in measured values can be prevented. As shown in FIG. 1B, in a case of a thick medium that is deflected in a different manner depending on a conveying path through which the thick medium is conveyed, if a transmitted-light-intensity information table (see Table 1) is prepared for each conveying path (for each medium accommodating unit), and an identifying process is performed by referring to the table corresponding to the conveying path, a medium type can be accurately identified.

TABLE 1

(a) Conveying path 1 (Medium feeding device 1 to N)

| Medium type | Range of transmitted light intensity $R_z$ |
|---|---|
| OHP sheet medium | $R_1$ |
| Copy of original | $R_2$ |
| Plain sheet medium | $R_3$ |
| Thick sheet medium 1 | $R_4$ |
| Thick sheet medium 2 | $R_5$ |

(b) Conveying path 2 (Bypass tray)

| Medium type | Range of transmitted light intensity Rz |
|---|---|

TABLE 1-continued

| | |
|---|---|
| OHP sheet medium | R1 |
| Copy of original | R2 |
| Plain sheet medium | R3 |
| Thick sheet medium 1 | R6 |
| Thick sheet medium 2 | R7 |

An operation of the conventional medium identifying device is described below with reference to FIGS. 2 to 5. FIG. 2 is a schematic diagram of the medium identifying device having the transmitted-light-intensity measuring unit. FIG. 3A is a schematic diagram illustrating a state where a thin sheet medium is conveyed to the transmitted-light-intensity measuring unit from a bypass tray. FIG. 3B is a schematic diagram illustrating a state where a thick sheet medium is conveyed to the transmitted-light-intensity measuring unit from the bypass tray.

The light emitting unit 110 that emits a light with a predetermined light intensity and the light receiving unit 111 that detects a light intensity of the emitted light are arranged to sandwich the medium 114 as a target for identifying the medium type. Accordingly, the transmitted light intensity in a thickness direction can be measured. A control unit 112 for the light emitting unit 110 and a control unit 113 for the light receiving unit 111 are arranged to identify the medium type and the state of the medium, such as a multiple feed state, based on the transmitted light intensity.

As shown in FIGS. 3A and 3B, when the medium 114 is conveyed from a bypass tray 120, the medium 114 is deflected in different manners in an area (indicated by "Y" in FIG. 2) between the upper guide plate 130*a* and the lower guide plate 130*b*. When the medium 114 is a paper sheet, even when the thickness of the medium 114 is uniform, the medium 114 may be deflected differently due to the effect of "a machine direction" of the medium 114. Besides, the medium 114 may curl or warp depending on the storage conditions (humidity, temperature, way of placement, or the like) under which the medium 114 is stored, which also affects the deflected shape (i.e., a deflection direction).

As a result, as shown in FIG. 3A, a thin medium may be deflected in a direction opposite to the expected direction in design (indicated by a solid line in FIG. 3A) in an area between the upper guide plate 130*a* and the lower guide plate 130*b* because of "the machine direction", the storage conditions, or the like. Furthermore, as shown in FIG. 3B, a thick medium may be deflected in a direction opposite to the expected direction (indicated by a solid line in FIG. 3B) because of the same reason.

FIG. 4 is a graph showing a relationship between a transmitted light intensity measured through a medium and a distance from the medium to a photodetecting element in the light receiving unit 111 for each medium having a different thickness. In FIG. 4, a vertical axis represents a light intensity V detected by a sensor, and a horizontal axis represents a distance Z from the photodetecting element to the medium. It can be found from FIG. 4 that, as the distance Z increases, the light intensity V (measured transmitted light intensity) increases. Furthermore, as the thickness of the medium decreases, measurement sensitivity increases, so that a distance dependency (tilt) is increased. When a medium of each type (thickness) is deflected as expected as indicated by a dashed line in FIG. 3A or FIG. 3B, a distance from the photodetecting element (a measurement point) to the medium corresponds to one of points A, B, C, and D indicated by double circles in FIG. 4A. Therefore, the transmitted light intensity of the medium corresponds to one of values V1, V2, V3, and V4. As for the deflected shape, it depends on the thickness of the medium. That is, a thin sheet medium or a plain sheet medium comes into contact with the upper guide plate 130*a* by being deflected, while a thick sheet medium or a super-thick sheet medium do not come into contact with the upper guide plate 130*a* even if it is deflected. Therefore, the distance Z for each of the point A (thin sheet) and the point B (plain sheet) equals to a distance Z1 that corresponds to the position of the upper guide plate 130*a*, while the distance Z comes closer to a distance Zm that corresponds to a midpoint between the upper guide plate 130*a* and the lower guide plate 130*b* as the thickness of the medium increases.

The medium is expected to deflect in a direction towards an area between the upper guide plate 130*a* and a position corresponding to the distance Zm. However, as described above, the medium may be deflected in a direction opposite to the expected direction (towards an area between the position corresponding to the distance Zm and the lower guide plate 130*b*). At this state, the measurement points are within a hatched area in FIG. 4. Specifically, the measurement points correspond to points symmetrical to the measurement points A, B, C, and D with respect to the distance Zm, that is, correspond to A', B', C', and D' indicated by single circles in FIG. 4. Because the light intensity V increases as the distance Z increases as described above, when the light intensity detected by the sensor is V' and the light intensity at the measurement points A', B', C', and D' are V1', V2', V3', and V4', respectively, the values V1', V2', V3', and V4' become larger than the values V1, V2, V3, and V4, respectively.

When detecting a thin sheet medium, a transmitted-light-intensity range set in the transmitted-light-intensity information table needs to be set in a range from V1 to V1'. However, the transmitted-light-intensity range from V1 to V1' partially overlaps with a transmitted-light-intensity range from V2 to V2' set in the transmitted-light-intensity information table corresponding to a plain sheet medium (an overlapped range is indicated by a dashed line part of the bold line indicating the distance dependency in FIG. 4). Therefore, if the sensor detects the transmitted light intensity within the overlapped range, an identification error may occur.

When the number of medium types to be used increase as shown in FIG. 5, the overlapped ranges increase (the dashed line parts of the bold lines indicating the distance dependency are increased in FIG. 5 than those in FIG. 4). As a result, a identification error is more likely to occur.

SUMMARY OF THE INVENTION

It is an object of the present invention to at least partially solve the problems in the conventional technology.

According to an aspect of the present invention, there is provided a device for measuring intensity of a transmitted light. The device includes a first measuring unit that measures a first intensity of a light transmitted through a medium on a conveying path in its thickness direction and outputs a first measured value; a second measuring unit that is arranged adjacent to the first measuring unit, measures a second intensity of the light transmitted through the medium in the thickness direction, and outputs a second measured value; and an operating unit that obtains a true measured value from the first measured value and the second measured value. The first measuring unit includes a first light-emitting unit that is arranged on a first side of the conveying path and emits a first light, and a first light-receiving unit that is arranged on a second side of the conveying path and receives the first light. The second measuring unit includes a second light-emitting unit that is arranged on the second side of the conveying path and emits a second light, and a second light-receiving unit that is arranged on the first side of the conveying path and receives the second light.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1A:
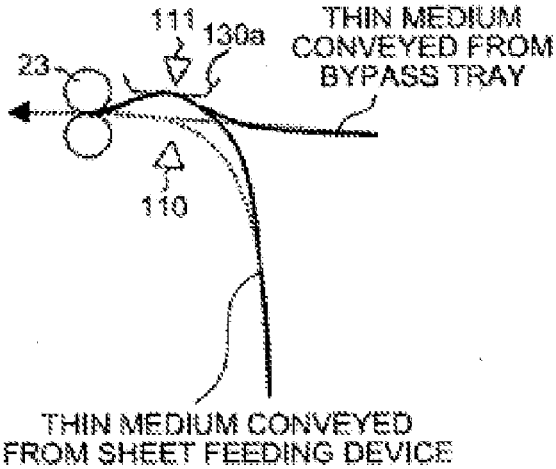
FIG.1A (Prior Art)
FIG. 1A is a schematic diagram illustrating a state where a thin sheet medium is conveyed to a conventional transmitted-light-intensity measuring unit from a bypass tray and a sheet feeding device.
Figure 1B:
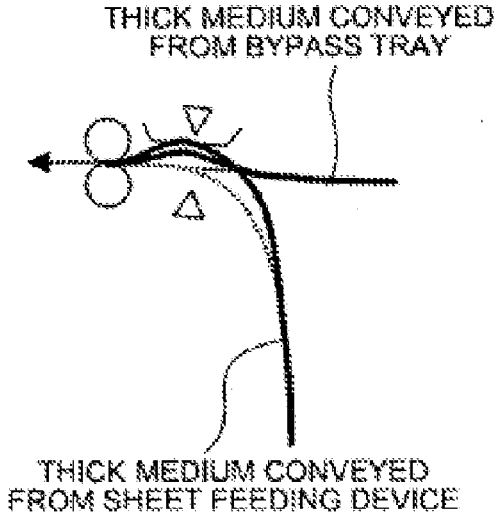
FIG.1B (Prior Art)
FIG. 1B is a schematic diagram illustrating a state where a thick sheet medium is conveyed to the conventional transmitted-light-intensity measuring unit from the bypass tray and the sheet feeding device.
Figure 2:
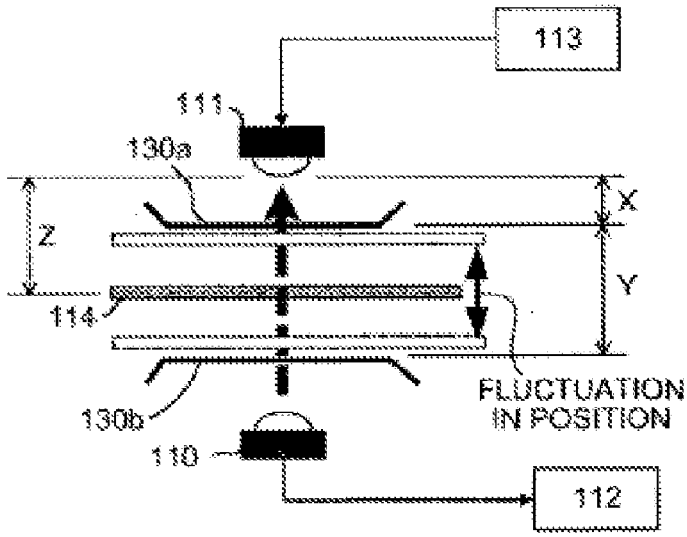
FIG.2 (Prior Art)
FIG. 2 is a schematic diagram of a medium identifying device having a conventional transmitted-light-intensity measuring unit.

Exemplary embodiments of the present invention are explained in detail below with reference to the accompanying drawings. In the following description, components that have the same functions as the components described above with reference to FIG. 1A to FIG. 5 are denoted by the same reference numerals.

It is assumed that an image forming apparatus of the following embodiments functions as a digital color copier that copies an image on an original onto a sheet by scanning and digitalizing the image. Moreover, the image forming apparatus has a facsimile function for transmitting and receiving image data of an original to and from a remote device, and a printer function for printing computer-readable image data on a medium such as a paper sheet.

Figure 9:
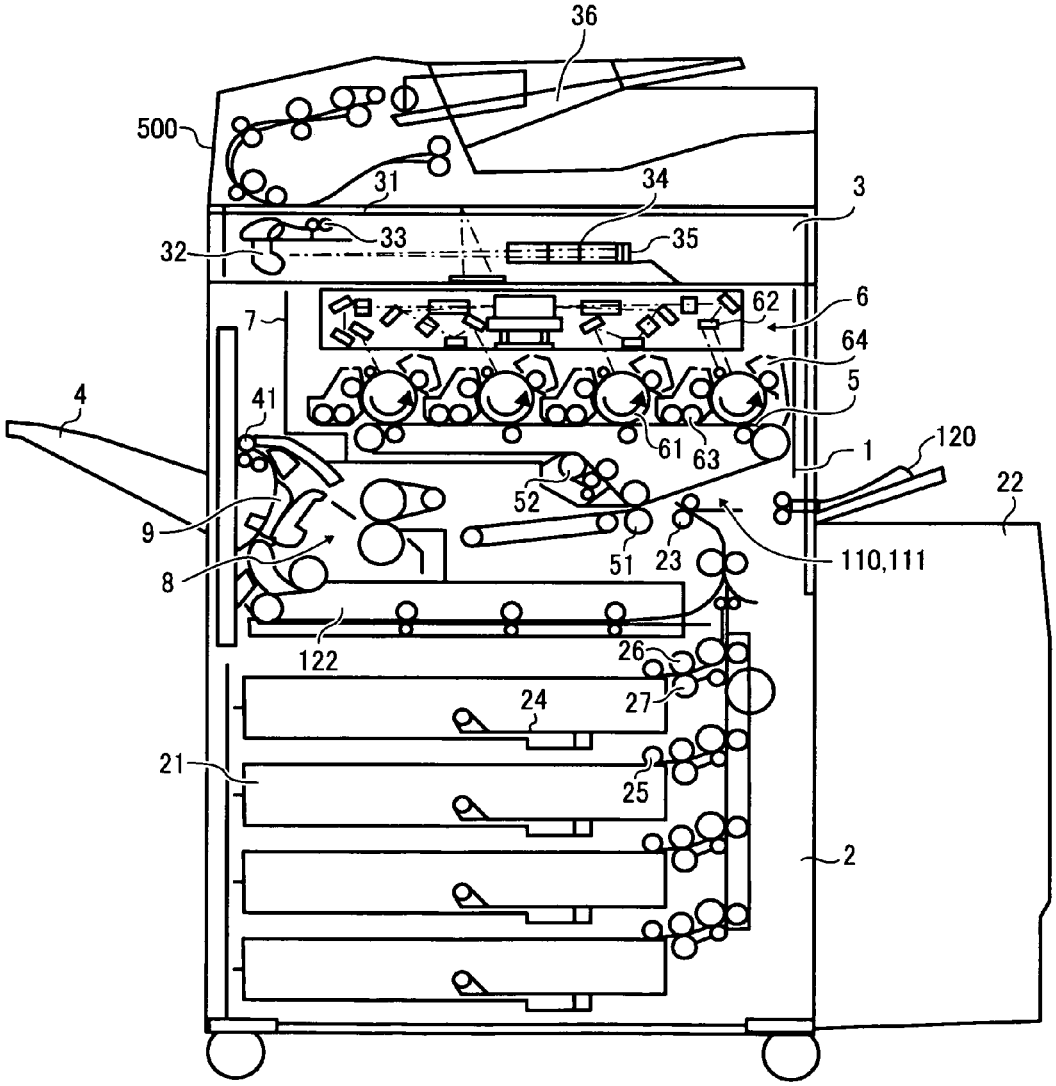
FIG. 9 is a schematic diagram of an image forming apparatus that includes a transmitted-light-intensity measuring unit in a registration area that is a junction of a plurality of medium conveying paths according to the present invention.

In FIG. 9, an image forming unit 1 is arranged in the substantially center area of the image forming apparatus. A multi-stage sheet feeding unit 2 is arranged below the image forming unit 1. A sheet feeding tray 21 is set at each stage of the sheet feeding unit 2. The sheet feeding tray 21 accommodates a stack of recording media, such as plain sheets, overhead projector (OHP) sheets, or copies of an original, and serves as a sheet feeding device. The sheet feeding tray 21 is detachable from a body of the image forming apparatus, and a sensor for detecting attachment or detachment of the sheet feeding tray 21 is set on the body. The sheet feeding unit 2 is configured so that a sheet feeding device 22 or the like can be added to the sheet feeding unit 2 as appropriate. The openable bypass tray 120 is arranged on a right side of the image forming unit 1 in FIG. 1. When the bypass tray 120 is opened as shown in FIG. 9 such that a top portion of the bypass tray 120 is separated from the body, sheets can be stacked on the bypass tray 120. A sensor (not shown) for detecting whether a sheet is on the bypass tray 120 is arranged in the image forming apparatus. A reading unit 3 that reads an original is arranged above the image forming unit 1. A discharged-sheet accommodating unit 4 is arranged on the left side of the image forming unit 1 in FIG. 1. A sheet on which an image is formed is discharged onto the discharged-sheet accommodating unit 4.

In the image forming unit 1, four image forming units 6 that form toner images of different colors, respectively, are arranged parallel to each other and opposing to a circumferential surface of an endless intermediate transfer belt 5. Each of the image forming units 6 includes a drum-type photosensitive element 61. A charging unit 62, an exposing unit 7, a developing unit 63, and a cleaning unit 64 are arranged around each of the photosensitive elements 61. The charging unit 62 charges the surface of the photosensitive element 61. The exposing unit 7 irradiates the surface of the photosensitive element 61 with laser light based on image information to thereby form an electrostatic latent image. The developing unit 63 develops the electrostatic latent image formed on the surface of the photosensitive element 61 to form a toner image of a corresponding color thereon. The cleaning unit 64 removes and collects residual toner remained on the surface of the photosensitive element 61.

In the reading unit 3, a reading carrier 32 and a reading carrier 33 are arranged in a reciprocating manner. The reading carrier 32 and the reading carrier 33 as a pair include a mirror (not shown) and a light source (not shown) that emits light with which an original (not shown) is irradiated. The reading carriers 32 and 33 scan an original (not shown) placed on an exposure glass 31, so that image data of the original can be read. The image data obtained by scanning the reading carriers 32 and 33 is read as an image signal by a charge coupled device (CCD) 35 arranged on the right side of a lens 34 in FIG. 1. The read image signal is digitalized and subjected to image processing. A laser diode (LD) (not shown) in the exposing unit 7 emits light based on the image signal that has been subjected to the image processing, so that an electrostatic latent image is formed on the surface of the photosensitive element 61. The light emitted from the LD reaches the photosensitive element 61 via a known polygon mirror, a known lens, and the like. An auto document feeder 36 that automatically conveys an original to the reading unit 3 is arranged on the reading unit 3.

A transferring unit 51 that transfers a full-color toner image formed on the intermediate transfer belt 5 onto a sheet is arranged around the intermediate transfer belt 5. An intermediate-transfer cleaning unit 52 is arranged near the transferring unit 51. The intermediate-transfer cleaning unit 52 removes and collects residual toner remained on the surface of the intermediate transfer belt 5 after the transferring unit 51 transfers the full-color toner image onto a sheet.

A process for forming an image by the image forming apparatus is described below. In each of the image forming units 6 shown in FIG. 9, a toner image of a corresponding color is formed on the surface of the photosensitive element 61 at predetermined timing along with a rotation of the intermediate transfer belt 5 by a known electrophotographic process. Specifically, first, in the image forming unit 6 for yellow arranged on the leftmost side in FIG. 9, a yellow toner image formed on the photosensitive element 61 is transferred onto the intermediate transfer belt 5. Then, in the image forming unit 6 for magenta arranged on the second leftmost side in FIG. 9, a magenta toner image formed on the photosensitive element 61 is transferred onto the yellow toner image on the intermediate transfer belt 5 in a superimposed manner. Then, in the image forming unit 6 for cyan arranged on the second rightmost side in FIG. 9, a cyan toner image formed on the photosensitive element 61 is transferred onto the magenta toner image on the intermediate transfer belt 5 in a superimposed manner. Then, in the image forming unit 6 for black arranged on the rightmost side in FIG. 9, a black toner image formed on the photosensitive element 61 is transferred onto the cyan toner image on the intermediate transfer belt 5 in a superimposed manner. In this manner, by sequentially superimposing toner images of four colors formed on the photosensitive elements 61, a full-color toner image is formed on the intermediate transfer belt 5.

In parallel with the image forming operation for forming the full-color toner image on the intermediate transfer belt 5, sheets are fed one by one from the sheet feeding tray 21 selected by a user among the sheet feeding trays 21 in the sheet feeding unit 2. Specifically, in the sheet feeding unit 2, sheets are stacked on a bottom plate 24 that is rotatably supported by the sheet feeding tray 21. The bottom plate 24 shifts upward while rotating until a top sheet of the stacked sheets comes into contact with a pickup roller 25. The pickup roller 25 picks up the top sheet while rotating, and a reverse roller 27 separates the top sheet from the stacked sheets. The top sheet separated from the stacked sheets is fed from the sheet feeding tray 21 towards the registration rollers 23 arranged on a downstream side in a medium conveying direction along with a rotation of a sheet feeding roller 26.

The sheet separated and conveyed in the above manner abuts a nip between the registration rollers 23, so that conveying of the sheet is suspended. The registration rollers 23 are controlled to start rotating at a predetermined timing so that a predetermined positional relation between the full-color toner image formed on the intermediate transfer belt 5 and a leading end of the sheet can be attained. Due to the rotation of the registration rollers 23, the suspended sheet is conveyed again. Accordingly, the full-color toner image formed on the intermediate transfer belt 5 is transferred onto a predetermined position on the sheet by the transferring unit 51.

The sheet onto which the full-color toner image has been transferred in the above manner is then conveyed to a fixing unit 8 on the downstream side in the medium conveying direction. The fixing unit 8 fixes the transferred full-color toner image to the sheet. The sheet on which the full-color toner image has been fixed is then discharged and accommodated in the discharged-sheet accommodating unit 4 by a pair of discharge rollers 41.

For forming an image on both sides of the sheet, a conveying direction of the sheet is switched at a switching unit (not shown) so that the sheet is guided to pass through an inverting unit 9, whereby the sheet is inverted. The inverted sheet abuts the nip between the registration rollers 23, so that skew of the sheet can be corrected. Then, an image is formed on the back side of the sheet in the same manner as described above.

Figure 10:
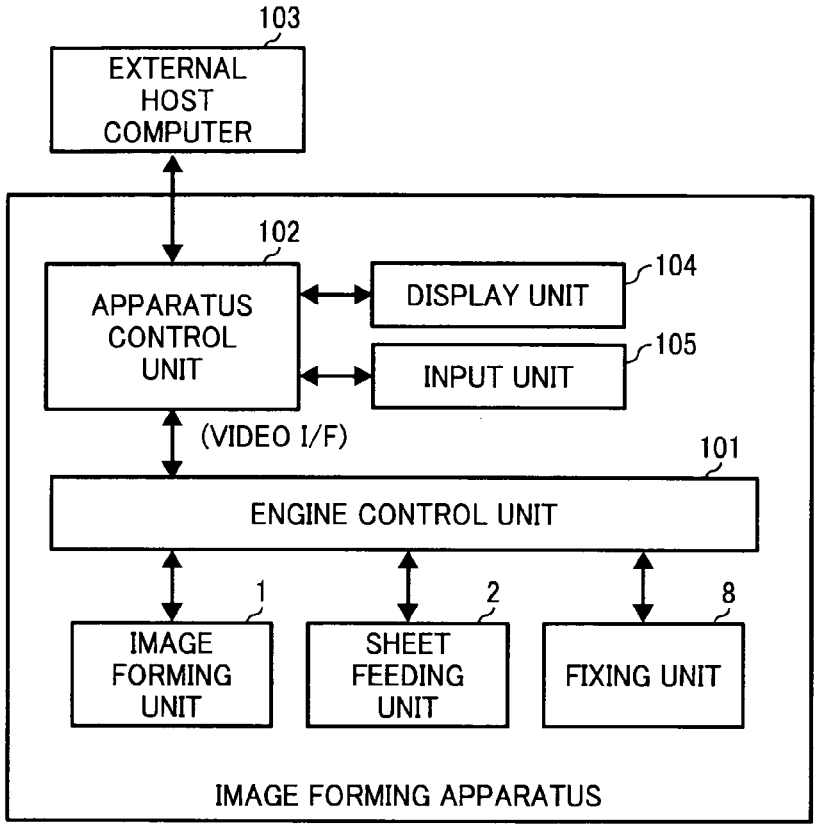
FIG. 10 is a block diagram of an electronic transmitting unit of the image forming apparatus shown in FIG. 9.

FIG. 10 is a block diagram of a control unit in the image forming apparatus shown in FIG. 9.

An engine control unit 101 controls a basic operation of main components, such as the image forming unit 1, the sheet feeding unit 2, and the fixing unit 8, in the image forming apparatus. An apparatus control unit 102 is connected to an external host computer 103, a display unit 104, an input unit 105, and the like. The apparatus control unit 102 manages the entire operation of a system of the image forming apparatus by receiving and managing information necessary for the operation from outside and providing necessary information to the engine control unit 101. The display unit 104 can be configured with a display of an operation panel. The input unit 105 can be configured with an operation button arranged on the operation panel. If the display unit 104 is configured as a touch panel, the touch panel can also be a part or whole of the input unit 105.

A storage unit (a medium-information storage unit or a measured-value storage unit) for managing various information and various determining units (operating units) of a medium identifying device can be arranged at any location if the storage unit and the determining unit are kept accessible. For example, the storage unit and the determining unit can be arranged in at least one of control units (not shown) in the engine control unit 101, the apparatus control unit 102, and the sheet feeding unit 2, or can be arranged in a plurality of storage units (not shown) or operating units (not shown). A medium setting unit for setting, in advance, a medium type of a medium to be used can be configured to include the input unit 105, a control program, which is stored in a predetermined memory unit (not shown), for storing setting contents in a memory serving as the medium-information storage unit while receiving input from the input unit 105, and an operating unit (not shown) that executes the control program. If the control program is for guiding a user for the setting operation of the medium type while displaying predetermined information on the display unit 104, the medium setting unit can be configured to further include the display unit 104. The medium setting unit can be configured in various other ways by using known technologies, such as technologies disclosed in Japanese Patent Application Laid-open No. 2002-311753 and Japanese Patent Application Laid-open No. 2003-

101720. The control program and the operating unit executing the control program that constitute the medium setting unit are arranged in at least one of the control units in the engine control unit 101, the apparatus control unit 102, and the sheet feeding unit 2, or in a plurality of the storage units or the operating units.

Figure 6:
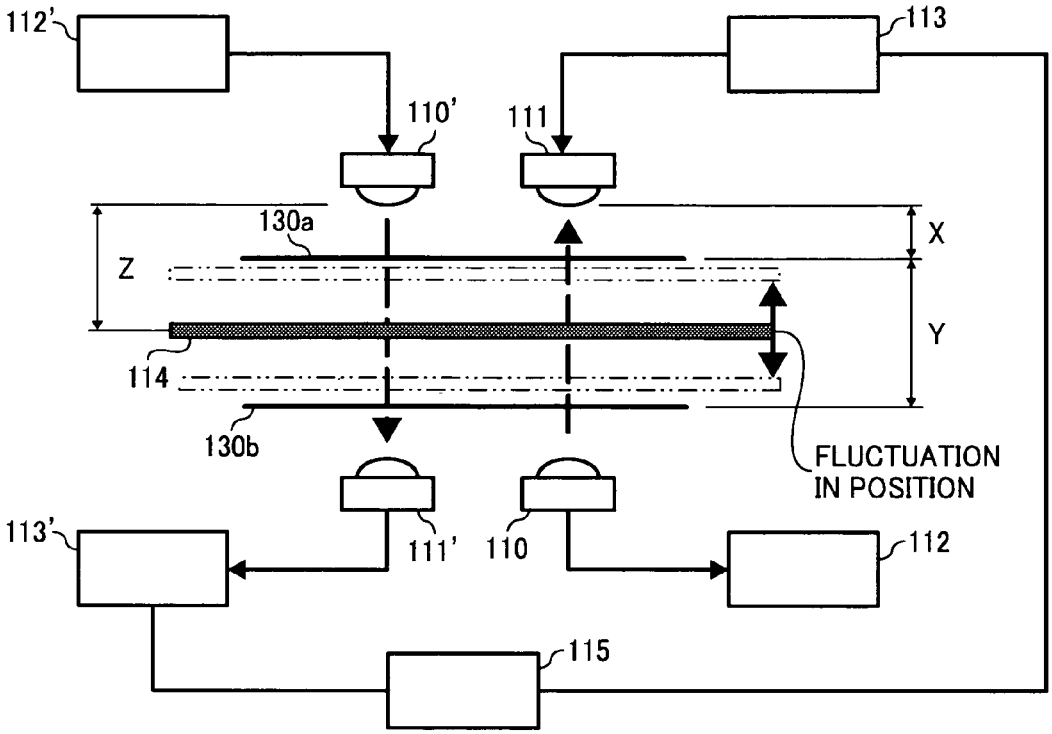
FIG. 6 is a schematic diagram of a medium identifying device that includes transmitted-light-intensity measuring units according to a first embodiment of the present invention.

A transmitted-light-intensity measuring unit according to the embodiments of the present invention is described below. FIG. 6 is a schematic diagram of a medium identifying device that includes the transmitted-light-intensity measuring units according to a first embodiment of the present invention. The medium identifying device includes the first light-emitting unit 110, the first light-receiving unit 111, the control unit 112 that controls the first light-emitting unit 110, the control unit 113 that controls the first light-receiving unit 111, a second light-emitting unit 110', a second light-receiving unit 111', a control unit 112' that controls the second light-emitting unit 110', a control unit 113' that controls the second light-receiving unit 111', a transmitted-light-intensity operating unit 115, the upper guide plate 130*a*, and the lower guide plate 130*b*. The first light-emitting unit 110 and the first light-receiving unit 111 that are arranged adjacent to each other are collectively referred to as a first transmitted-light-intensity measuring unit, and the second light-emitting unit 110' and the second light-receiving unit 111' that are arranged adjacent to each other are collectively referred to as a second transmitted-light-intensity measuring unit.

As shown in FIG. 6, the first transmitted-light-intensity measuring unit and the second transmitted-light-intensity measuring unit are arranged so that one is upside down with respect to the other. As described above, because a transmitted light intensity is proportional to a distance from the medium 114 to a photodetecting element, two different measurement results (a first measured value and a second measured value) are obtained by the first transmitted-light-intensity measuring unit and the second transmitted-light-intensity measuring unit. The transmitted-light-intensity operating unit 115 selects smaller one of the first measured value and the second measured value as a true value so that the selected value can be out of an overlapped transmitted-light-intensity range.

In this manner, according to the present embodiment, an error in identifying a medium type due to overlapping of the transmitted-light-intensity ranges in the above-mentioned table can be assuredly prevented.

Figure 4:
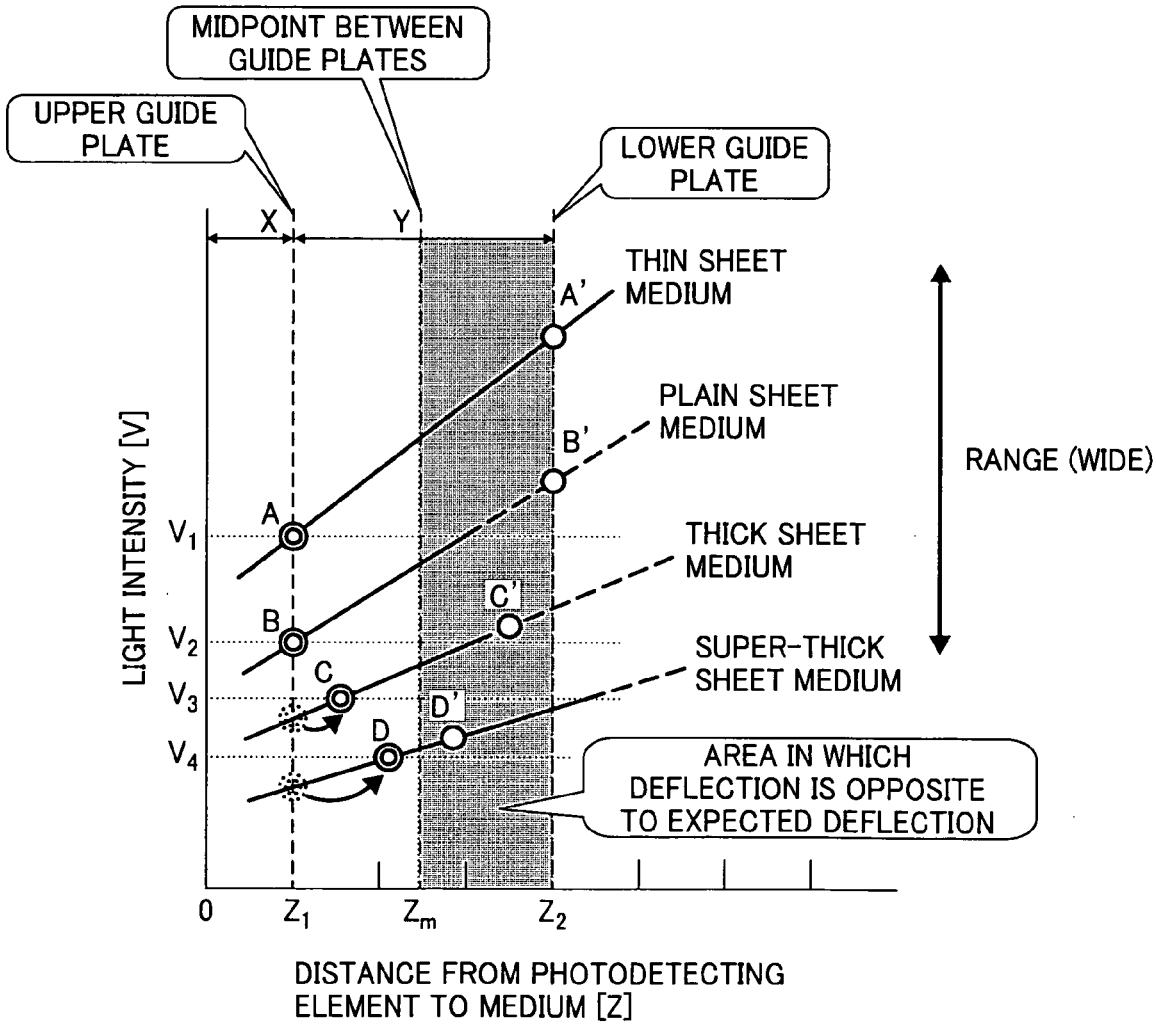
FIG. 4 is a graph showing a relationship between a transmitted light intensity measured through a medium and a distance from the medium to a photodetecting element for each medium having a different thickness.

More particularly, an example of identifying a medium type when a thin sheet medium and a plain sheet medium are sequentially conveyed is described below with reference to FIG. 4. When the thin sheet medium comes into contact with the upper guide plate 130*a*, a distance from the thin sheet medium to the photodetecting element equals to Z1 at a position corresponding to the first transmitted-light-intensity measuring unit. Therefore, the first transmitted-light-intensity measuring unit measures the light intensity V1 at the measurement point A. On the other hand, a distance from the thin sheet medium to the photodetecting element equals to Z2 at a position corresponding to the second transmitted-light-intensity measuring unit. Therefore, the second transmitted-light-intensity measuring unit measures the light intensity V1' at the measurement point A'. Likewise, when the plain sheet medium comes into contact with the upper guide plate. 130*a*, the first transmitted-light-intensity measuring unit measures the light intensity V2 at the measurement point B, and the second transmitted-light-intensity measuring unit measures the light intensity V2' at the measurement point B'.

In this case, the transmitted-light-intensity operating unit 115 can identify the medium type by comparing smaller values (V1 and V2) that are out of an overlapped transmitted-light-intensity range among the first measured values (V1 and V1') and the second measured values (V2 and V2') measured by the transmitted-light-intensity operating unit 115. Accordingly, whether a medium is the thin sheet medium or the plain sheet medium can be assuredly identified. Thus, an error in identifying the medium type due to overlapping of the transmitted-light-intensity ranges in the transmitted-light-intensity information table can hardly occur.

Figure 3A:
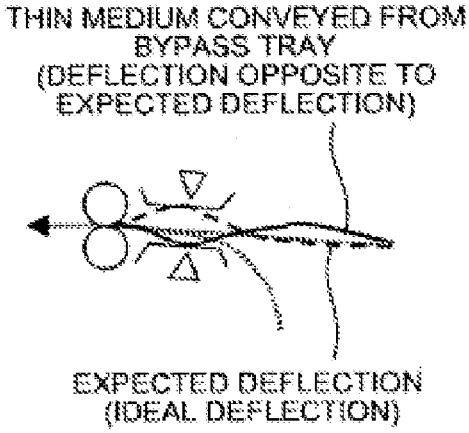
FIG.3A (Prior Art)
FIG. 3A is a schematic diagram illustrating a state where a thin sheet medium is conveyed to the conventional transmitted-light-intensity measuring unit from a bypass tray.
Figure 3B:
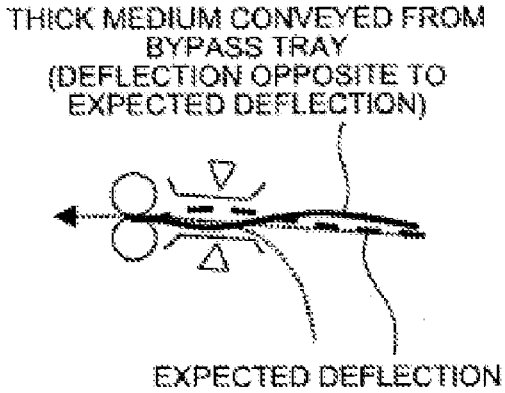
FIG.3B (Prior Art)
FIG. 3B is a schematic diagram illustrating a state where a thick sheet medium is conveyed to the conventional transmitted-light-intensity measuring unit from the bypass tray.

A transmitted-light-intensity measuring unit according to a second embodiment of the present invention is described below. In the first embodiment, a medium type is identified by comparing smaller values of the first measured values and the second measured values. However, even the same medium may be deflected differently due to the effect of "the machine direction". Furthermore, the medium may be curled or warped depending on the storage conditions (humidity, temperature, way of placement, or the like) under which the medium is stored, which also affects a deflected shape of the medium. Now, an example is assumed in which a first medium having a predetermined thickness and a second medium having a thickness thicker by one rank than the first medium are sequentially conveyed. When the first medium is deflected as expected and comes into contact with the upper guide plate 130*a* and the second medium remains at a midpoint between the distances Z1 and Zm without coming into contact with the upper guide plate 130*a* by being deflected, or when the first medium comes into contact with the upper guide plate 130*a* and the second medium is deflected in the opposite direction as shown in FIG. 3B, if the number of medium types is small, the medium type can be correctly identified. However, if the number of medium types is large as shown in FIG. 5, an error in identification is more likely to occur.

To solve the above problem, in the second embodiment, the transmitted-light-intensity operating unit calculates an average of the first measured value and the second measured value as a new parameter. In other words, the parameter is calculated by dividing the sum of the first measured value and the second measured value by two. Thus, the parameter corresponds to a value measured at the midpoint Zm between the upper guide plate 130*a* and the lower guide plate 130*b*. Specifically, the parameter corresponds to one of values V1*m*, V2*m*, V3*m*, V4*m*, and V5*m* measured at measurement points A, B, C, D, and E indicated by black circles in FIG. 5. Here, Vzm=(Vz+Vz')/2, and Z=1 to 5.

Figure 5:
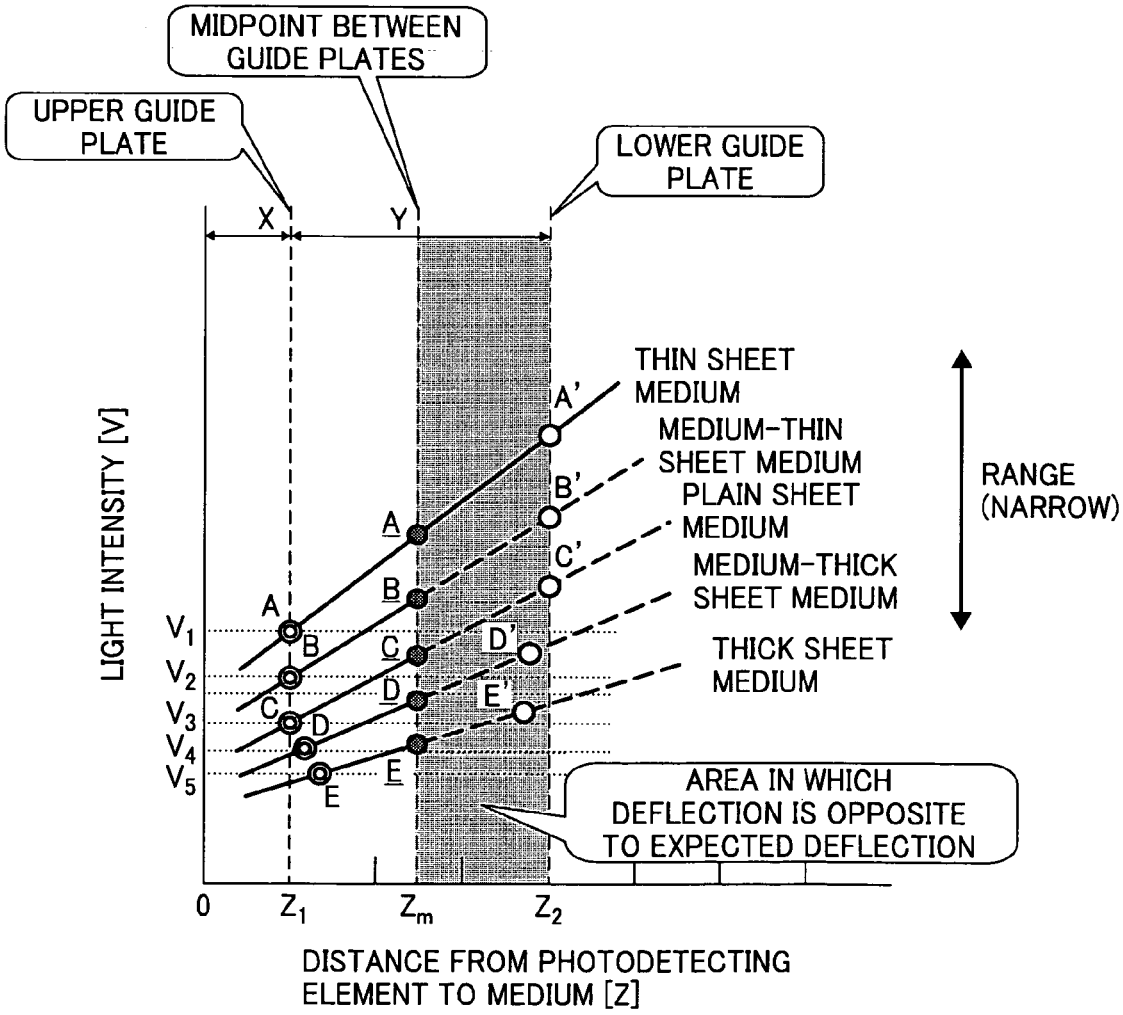
FIG. 5 is a graph showing a relationship between a transmitted light intensity measured through a medium and a distance from the medium to a photodetecting element for each medium having a different thickness.

For example, when a thin sheet medium and a medium-thin sheet medium are measured under the conditions shown in FIG. 5, and if an average is not used as the parameter, a range R1 from V1 to V1' and a range R2 from V2 to V2' partially overlap with each other in the range from V1 to V2'. To prevent the above situation, in the second embodiment, if a transmitted-light-intensity range used for identifying a medium type is represented by Rz (Z=1 to 5), the range for the thin sheet medium is set as R1=V1±α % and the range for the medium-thin sheet medium is set as R2=V2±α % by using the values V1*m* and V2*m* that correspond to values measured at the midpoint Zm between the upper guide plate 130*a* and the lower guide plate 130*b* and are uniquely determined for each medium type while considering measurement deviation. By setting R1 and R2 as above, R1 and R2 do not overlap each other. Thus, regardless of a positional relation between the photodetecting element and the medium, a parameter in which fluctuation in the positional relation is cancelled out can be obtained. As a result, a medium type can be identified correctly regardless of a deflected shape of the medium (deflection direction).

Figure 7:
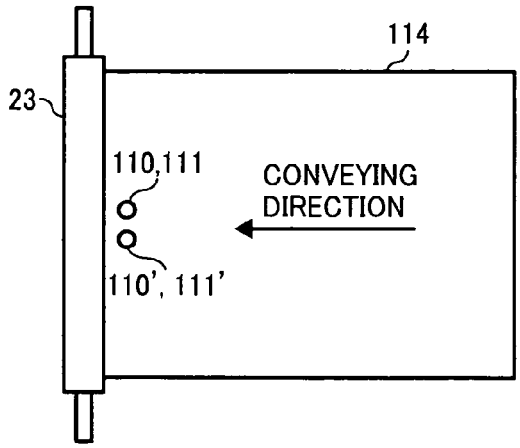
FIG. 7 is a schematic diagram of a medium identifying device that includes transmitted-light-intensity measuring units that are arranged in parallel in a direction perpendicular to a medium conveying direction according to a third embodiment of the present invention.

A transmitted-light-intensity measuring unit according to a third embodiment of the present invention is described below. As shown in FIG. 7, the first transmitted-light-intensity measuring unit and the second transmitted-light-intensity measuring unit are arranged in parallel in a direction perpendicular to a medium conveying direction. With this configuration, measurement deviation due to the amount of deflection of the medium (a measurement distance) can be reduced, enabling stable measurement. The first transmitted-light-intensity measuring unit and the second transmitted-light-intensity measuring unit are preferably arranged as close as possible to each other while assuring measurement capability.

As described above, Rz=(Vz+Vz')/2=Vzm. However, considering that slight deviation may occur in an actual measurement and medium characteristic may vary between the media of the same medium type, such as a plain sheet medium, the value of the range Rz is set so that Rz≈Vz. Thus, the effect of the measurement deviation can be reduced and processes of identifying a medium type can be simplified.

Figure 8:
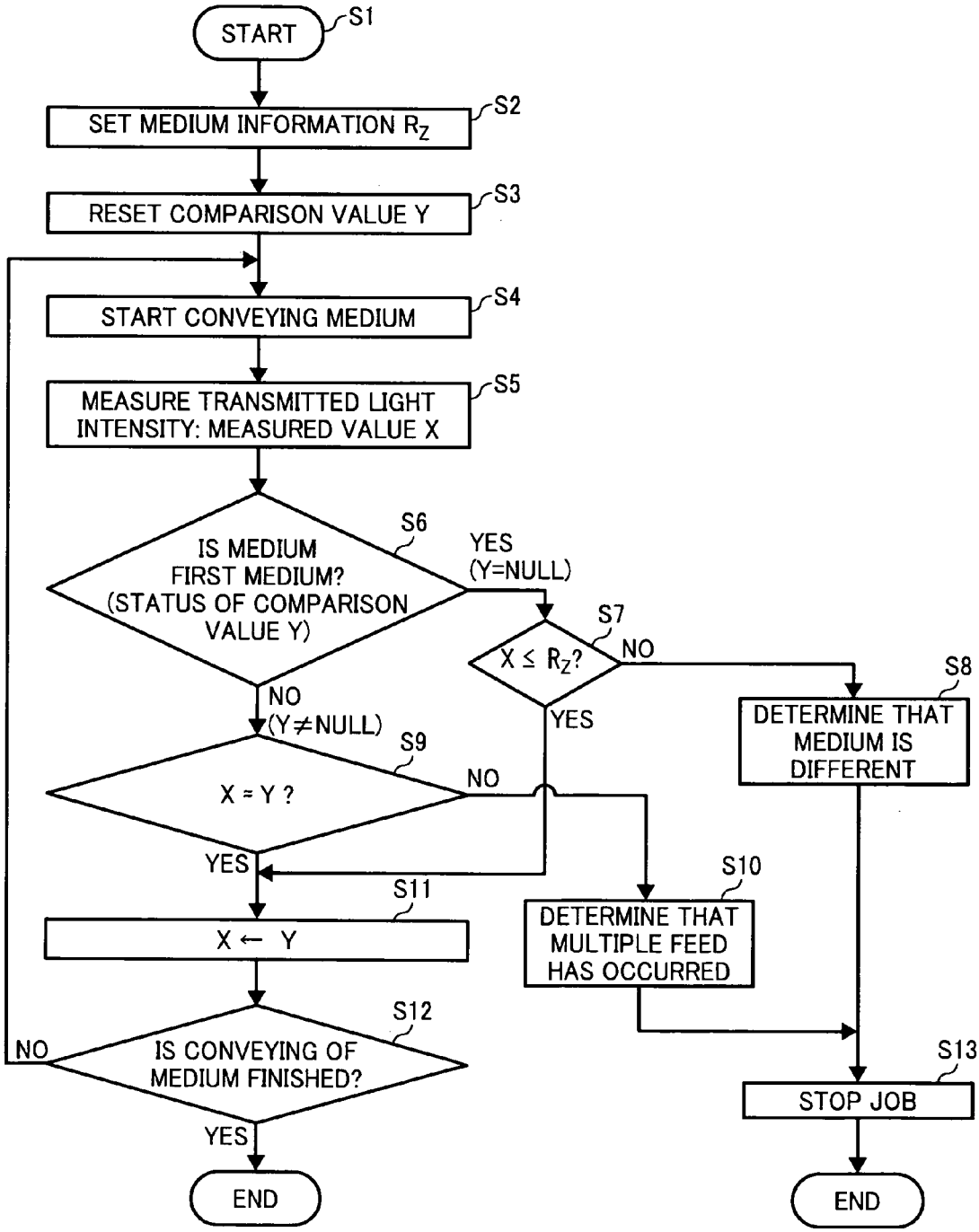
FIG. 8 is a flowchart of a control process of identifying a medium type according to a fourth embodiment of the present invention.

A transmitted-light-intensity measuring unit according to a fourth embodiment of the present invention is described below. FIG. 8 is a flowchart of a control process of identifying a medium type. A routine from Step S1 to Step S5 corresponds to a process of measuring a transmitted light intensity of a medium. In the routine, medium information, such as a medium type, is selected and set (Step S2). Following the setting, range-value information (R1 to R5) corresponding to the selected medium type is read from the following Table 2, that is, a transmitted-light-intensity information table that is set for each medium type and stored in the medium-information storage unit in advance, and then the read range-value information is set as a comparison value (range value) Rz used for identifying the medium type (Step S2).

TABLE 2

| Medium type | Range of transmitted light intensity Rz |
|---|---|
| OHP sheet medium | R1 |
| Copy of original | R2 |
| Plain sheet medium | R3 |
| Thick sheet medium 1 | R4 |
| Thick sheet medium 2 | R5 |

After the medium information is set, a comparison value Y is reset (Step S3). The comparison value Y indicates a previous transmitted light intensity of a previously-conveyed medium, which is calculated and stored through a previous measurement process (i.e., a measured value obtained by the transmitted-light-intensity operating unit). The comparison value Y is used for detecting the multiple feed. When conveying of the medium is started at any timing (Step S4), the transmitted light intensity of the medium is measured at a predetermined timing, the transmitted-light-intensity operating unit obtains a measured value X based on the measured transmitted light intensity, and the measured value X is temporarily stored in a memory (Step S5).

Then, whether the medium is the first medium is determined. Depending on a result of this determination, whether "a medium-type identifying process" or "a multiple feed detecting process" is to be performed is determined. Specifically, at Step S6, whether any value is set as the comparison value Y is determined (Step S6). When the first medium is conveyed, whether the medium is the first medium can be determined because the comparison value Y is reset (NULL is set in the comparison value Y) (Step S3) after the medium information is set before the medium is conveyed (Step S2). When the medium is the first medium (Y=NULL at Step S6), process control proceeds to Step S7, at which the medium-type identifying process is performed.

At Step 7, the measured value X and the range-value information Rz are compared with each other. When the measured value X is within a range indicated by Rz (Yes at Step S7), it is determined that the medium corresponds to medium setting. Then, the measured value X is set as the comparison value Y (Step S1), and the medium is continuously conveyed. On the other hand, when the measured value X is out of the range indicated by Rz (No at Step S7), it is determined that the medium does not correspond to the medium setting (Step S8). Therefore, conveying of the medium is suspended, and a notification about "setting failure" or "medium setting failure" is issued (Step S13).

The comparison value Y set at Step S11 corresponds to a measurement result stored in the measured-value storage unit. Furthermore, the memory unit, in which the comparison value Y is stored, corresponds to the measured-value storage unit.

When it is determined that the medium is continuously conveyed at Step S12, process control returns to Step S4, and a transmitted light intensity of a next medium is measured (Step S5). In the process at Step S6, because the comparison value Y that is the measured value X of the previous medium is already set, it is determined that the medium is the second medium (process is performed for the second time), and process control proceeds to Step S9 where the multiple feed detecting process is performed. Then, the comparison value Y (obtained from the previous medium) and a second measured value X (obtained from a current medium) are compared with each other. When the multiple feed occurs (two or more overlapped media are conveyed at one time), a transmitted light intensity of the overlapped media generally becomes smaller than that of a single medium. For example, when two media are overlapped during conveying, the transmitted light intensity obtained from the overlapped media is reduced by substantially half or smaller than that of a single medium in theory. By using this theory, the multiple feed can be detected. The comparison value Y is set as a range value in consideration of measurement deviation in a single medium. For example, when the measured value X is obtained from a previous medium, the comparison value Y is set to approximately satisfy the equation Y=X±30%, so that an error in detecting the multiple feed can be assuredly prevented. When the measured value X is much smaller than the comparison value Y (No at Step S9), it is determined that the multiple feed has occurred (Step S10). Accordingly, conveying of the medium is suspended, and a notification about the occurrence of the multiple feed is issued (Step S13). Thereafter, the same routines as described above are repeated. While the routines are repeated, the routines at Step S5 and Step S11 are also repeated. Therefore, the contents stored in the measured-value storage unit are re-written every time the transmitted-light-intensity measuring unit measures a transmitted light intensity through a medium.

When conveying of the medium is normally completed at Step S12, and if the medium setting is not changed or a medium is not changed, the comparison value Y is maintained without being reset, so that the control process can be simplified.

By the above control process, it is possible to perform the medium-type identifying process when a medium is the first medium (process performed at the first time), and the multiple feed detecting process when a medium is the second or later medium (process performed for the second or later time).

A transmitted-light-intensity measuring unit according to a fifth embodiment of the present invention is described below.

Conventionally, timing for deflecting a medium while suspending the medium at the registration rollers are counted by using a special detecting unit. However, according to the embodiment, as shown in FIG. 7, arrival of a medium at a registration area can be detected by the first light-emitting unit 110, the second light-emitting unit 110', the first light-receiving unit 111, and the second light-receiving unit 111', which are arranged just before a skew correcting unit (the registration rollers 23) in the medium conveying direction. Thus, the transmitted-light-intensity measuring unit has-additionally a detection function, so that costs can be reduced.

Figure 13:
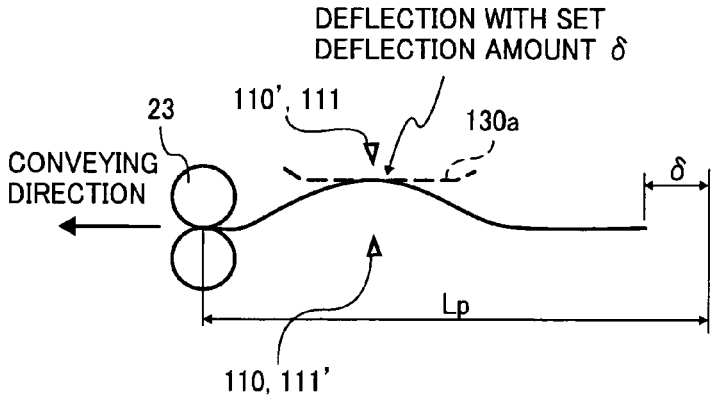
FIG. 13 is a schematic diagram for explaining a deflection set value.

If a medium is not sufficiently deflected as shown in FIG. 13, skew of the medium may not be sufficiently corrected during an image forming process that is performed after the registration rollers are re-driven. In this case, image quality, such as copy quality, may be degraded because of skew of a resultant image.

Figure 11:
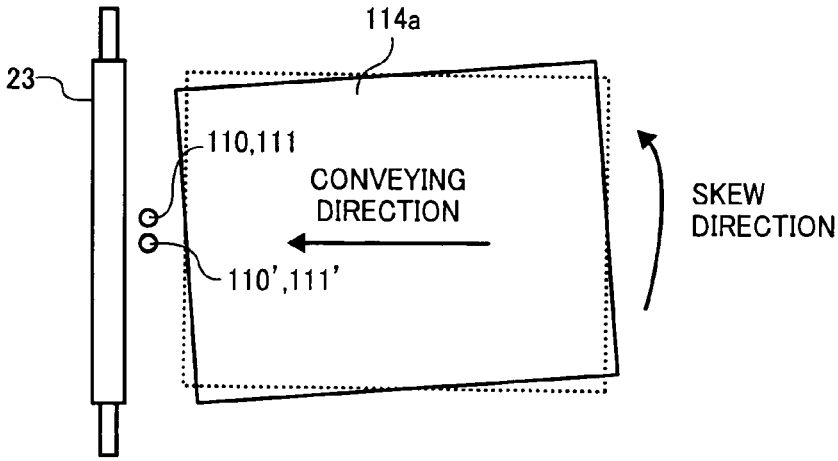
FIG. 11 is a schematic diagram for explaining how a skew amount of a medium is measured by two transmitted-light-intensity measuring units arranged parallel to registration rollers according to a fifth embodiment of the present invention.
Figure 12:
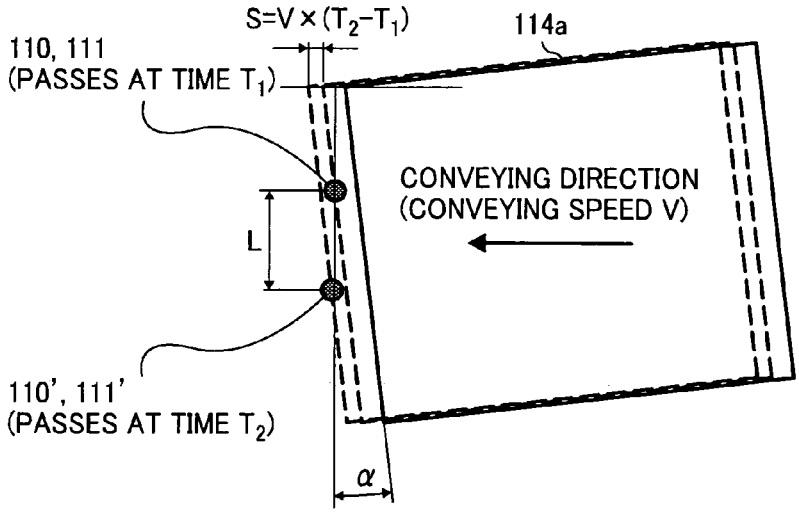
FIG. 12 is a schematic diagram for explaining how a skew amount of a medium is calculated.
Figure 14:
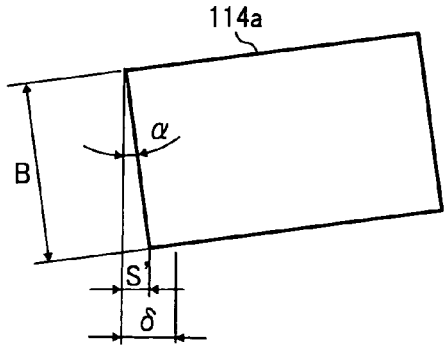
FIG. 14 is a schematic diagram illustrating a relationship between the deflection set value and a skew amount.

To solve the above problem, as shown in FIG. 11, the first transmitted-light-intensity measuring unit and the second transmitted-light-intensity measuring unit, which are sensors, are arranged parallel to the registration rollers 23 so that the amount of skew of a medium 114*a* (sheet) can be measured when the medium 114*a* is skewed while being conveyed. Then, a determining unit (not shown) determines whether the amount of skew exceeds a predetermined threshold. Specifically, as shown in FIG. 12, a skew angle is obtained based on a time difference between a time when the medium 114*a* passes through the first transmitted-light-intensity measuring unit and a time when the medium 114*a* passes through the second transmitted-light-intensity measuring unit, and then, the amount of skew (skew amount) with respect to a width of the medium 114*a* is calculated through a conversion operation based on a ratio with respect to the width of the medium 114*a*. More particularly, a shift amount S [mm] indicating a distance from a point at which the medium 114*a* passes through one of the sensors and a point at which the medium 114*a* passes through the other one of the sensors can be obtained by $S=V\times|T1-T2|$, where T1 [s] is a time when the medium 114*a* passes through one of the sensors, T2 [s] is a time when the medium 114*a* passes through the other one of the sensors, L [mm] is a distance between the sensors, and V [mm/s] is a medium conveying speed. At this state, a skew angle $\alpha$ can be obtained by $\alpha=\tan^{-1}(S/L)$. Furthermore, as shown in FIG. 14, a skew amount S1 [mm] with respect to a width B [mm] of the medium 114*a* can be obtained by $S'=B\times\tan\alpha$.

The first and the second transmitted-light-intensity measuring units are not necessarily arranged perpendicular to the medium conveying direction. When the first and the second transmitted-light-intensity measuring units are tilted with respect to the medium conveying direction, a time difference between times when a medium passes the first and the second transmitted-light-intensity measuring units can be obtained by correcting an amount of an angle tilted from the conveying direction.

Explanation about a correctable skew amount is given below. As described above, $\alpha=\tan-1(S/L)=\tan-1(S'/B)$, so that the size of the skew angle $\alpha$ depends on the size of the skew amount S'. Therefore, by comparing a deflection set value (a deflected amount) $\delta$ with the skew amount S', it is possible to determine whether the skew can be corrected. As shown in FIGS. 13 and 14, when $\delta>S'$, the skew can be corrected. On the other hand, when $\delta<S'$, the skew cannot be corrected sufficiently, so that an image formed on a medium in a subsequent image forming process may be skewed. By determining whether such a situation occurs before performing the image forming process to prevent forming of an undesired image such as a skewed image, quality of a resultant image can be assured.

Figure 15:
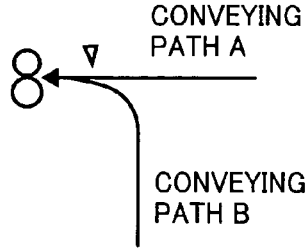
FIG. 15 is a schematic diagram of conveying paths.

The maximum value of the deflection set value (the deflected amount) $\delta$ is determined based on the upper guide plate 130*a* that controls the deflection shape. That is, the maximum value depends on the configuration of a medium conveying path (see FIG. 13). When the deflection amount is set too large, skew correction may not be correctly performed or a medium may be twisted. Such problems are more likely to occur with a thin sheet medium. On the other hand, because repelling force of the medium increases as the thickness of the medium increases, the deflection amount of a thick sheet medium becomes smaller than that of a plain sheet medium. Therefore, the maximum value of the deflection set value (the deflected amount) $\delta$ of the thick sheet medium becomes smaller than that of the plain sheet medium. Considering the above fact, a threshold setting unit (not shown) is used to arbitrary set a threshold Xn of the maximum value of the deflection set value $\delta$ that is measured in advance through an experimental measurement or the like and depends on medium-conveying conditions such as a conveying path, a medium type, or a medium size, and compares the skew amount S' with the set threshold Xn. Therefore, it is possible to determine whether skew of the medium is correctable depending on the medium-conveying condition (see Table 3 and FIG. 15).

TABLE 3

| | Conveying path A | | | Conveying path B | | |
|---|---|---|---|---|---|---|
| | A3 | A4T | A5T | A3 | A4T | A5T |
| Medium type A (Thin sheet medium) | Xa1 | Xa2 | Xa3 | Xb1 | Xb2 | Xb3 |
| Medium type B (Plain sheet medium) | Xa4 | Xa5 | Xa6 | Xb4 | Xb5 | Xb6 |
| Medium type C (Thick sheet medium) | Xa7 | Xa8 | Xa9 | Xb7 | Xb8 | Xb9 |
| Medium type D (Special sheet medium) | Xa10 | Xa11 | Xa12 | Xb10 | Xb11 | Xb12 |

Figure 16:
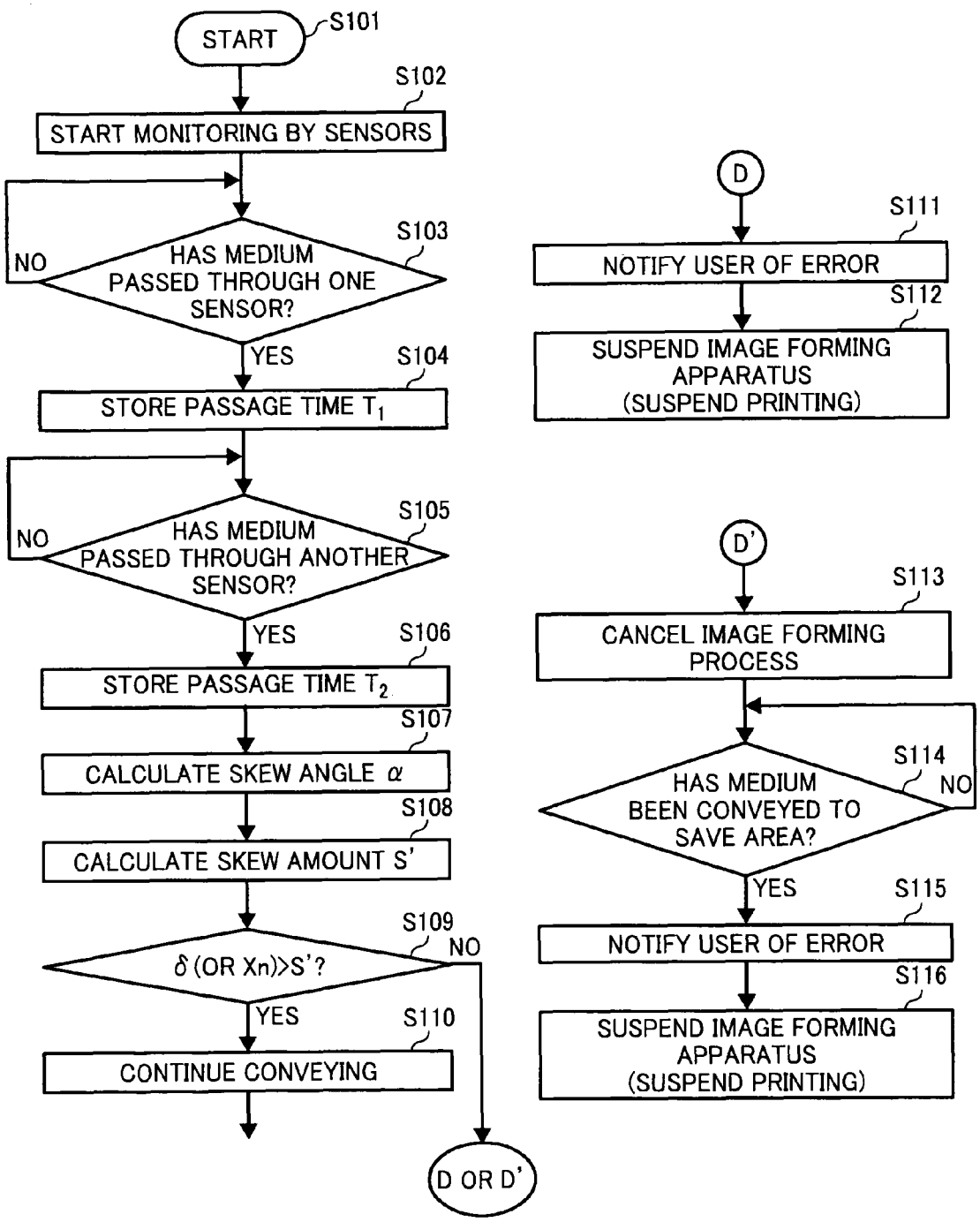
FIG. 16 is a flowchart of a control process of identifying the state of a medium according to the fifth embodiment of the present invention.

A control process is described below with reference to FIG. 16. A printing is started in a routine at Step S101, and a medium is conveyed. Two sensors start monitoring the medium when the medium is conveyed to a predetermined point upstream of the sensors in a medium conveying direction (Steps S102, S103, and S105). Then, a passage time when the medium passes through each of the sensors is stored (Steps S104 and S106). The skew angle $\alpha$ is calculated (Step S107), and the skew amount S' that corresponds to the amount to be actually corrected with respect to a medium width is calculated (Step S108). The skew amount S' is compared with the deflection set value $\delta$ (or the threshold Xn) (Step S109). When $\delta$ (or Xn)>S' (Yes at Step S109), it is determined that the skew can be corrected, so that the medium is continuously conveyed (Step S110). On the other hand, when the above inequality is not satisfied (No at Step S109), process control proceeds to D or D'. At D, when occurrence of an error is detected, a notification about the occurrence of the error is issued (Step S111), and an image forming apparatus is immediately suspended (Step S112). At D', an image forming process is canceled (Step S113), and the medium is conveyed to a predetermined save area (Step S114). After the medium is conveyed to the predetermined save area, a notification about the occurrence of the error is issued similar to the process at Step S11 (Step S115), and the image forming apparatus is immediately suspended (Step S116). It is preferable to set the save area, to which the medium is conveyed, within an area in which a residual medium can be easily handled. Specifically, the save area can be provided in a double siding unit 122 shown in FIG. 9, the discharged-sheet accommodating unit 4, a discharge tray (not shown) used in post processing, or the like.

The control processes D and D' can be selected as appropriate depending on the level of the skew amount. This is because when the skew amount is so large that the medium may abut the guide plate or the like and therefore it is physically difficult to convey the medium to the save area, the image forming apparatus needs to be suspended immediately.

According to one aspect of the present invention, it is possible to obtain transmitted-light-intensity information suitable for an image forming apparatus by selecting effective one of the measured values or calculating a parameter from the measured values.

Furthermore, according to another aspect of the present invention, the transmitted-light-intensity measuring device can obtain a highly-reliable measured value regardless of a positional relation (measurement distance) between the medium and the photodetecting element.

Moreover, according to still another aspect of the present invention, the transmitted-light-intensity measuring device can prevent measurement deviation caused by a difference in the deflected shape of the medium (deflection amount), so that a highly-reliable measured value can be obtained.

Furthermore, according to still another aspect of the present invention, additional detecting unit is not necessary in the transmitted-light-intensity measuring device, so that costs can be reduced and it is easy to obtain an absolute value of the skew amount in the width direction of the medium being conveyed.

Moreover, according to still another aspect of the present invention, the transmitted-light-intensity measuring unit can detect a medium that is skewed by the amount that is not correctable before performing an image forming process.

Furthermore, according to still another aspect of the present invention, the transmitted-light-intensity measuring unit can set a threshold depending on use conditions such as a medium size, a medium type, or a conveying path, so that occurrence of an error can be assuredly detected.

Moreover, according to still another aspect of the present invention, the medium identifying device can obtain a highly-reliable transmitted light intensity (a calculated value), so that a medium type can be identified accurately and reliably.

Furthermore, according to still another aspect of the present invention, the medium identifying device can assuredly identify a medium type even when a measured value fluctuates due to paper dust or the like.

Moreover, according to still another aspect of the present invention, the medium identifying device can prevent a medium in an abnormal situation from being further conveyed to a downstream side, and can notify a user of occurrence of such an error.

Furthermore, according to still another aspect of the present invention, the image forming apparatus can assuredly prevent degradation of quality of images to be output, so that the image forming apparatus can meet growing market demand.

When outputting an image by a copier, a printer, or the like, image skew (sheet skew) may occur, degrading printing quality of the image. According to the present invention, two transmitted-light-intensity measuring units counts a time of passage of a leading edge and a trailing edge of the medium, and calculates a time difference to measure a skew angle of the medium. Therefore, the skew angle of the medium can be measured without using a dedicated sensor, such as a conveyor sensor, which is used in the conventional technology. As a result, costs can be reduced. On the other hand, when skew of the medium is physically corrected by using registration rollers or the like, the amount of skew to be corrected is limited. Therefore, when actual skew amount calculated based on a determination process on the medium exceeds a correctable amount, it is preferable to suspend normal conveying of the medium and convey the medium to a predetermined save area to prevent a skewed image.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A device for measuring intensity of a transmitted light, the device comprising:

a first measuring unit that measures a first intensity of a light transmitted through a medium on a conveying path in its thickness direction and outputs a first measured value;

a second measuring unit that is arranged adjacent to the first measuring unit, measures a second intensity of the light transmitted through the medium in the thickness direction, and outputs a second measured value; and an operating unit that obtains a true measured value from the first measured value and the second measured value, wherein the first measuring unit includes a first light-emitting unit that is arranged on a first side of the conveying path and emits a first light, and a first light-receiving unit that is arranged on a second side of the conveying path and receives the first light, the second measuring unit includes a second light-emitting unit that is arranged on the second side of the conveying path and emits a second light, and a second light-receiving unit that is arranged on the first side of the conveying path and receives the second light.

2. The device according to claim 1, wherein the operating unit calculates an average of the first measured value and the second measured value to obtain the true measured value.

3. The device according to claim 1, the first measuring unit and the second measuring unit are arranged in parallel in a direction perpendicular to a medium conveying direction.

4. The device according to claim 3, wherein the operating unit calculates a skew amount of the medium that is skewed on the conveying path based on a time difference between a first time when the medium passes through the first measuring unit and a second time when the medium passes through the second measuring unit.

5. The device according to claim 4, further comprising a determining unit that determines whether the skew amount exceeds a predetermined threshold.

6. The device according to claim 5, further comprising a setting unit that sets the threshold.

7. A device for conveying a medium, comprising:

the device according to claim 5; and a control unit that determines whether the skew amount exceeds the threshold, and when it is determined that the skew amount exceeds the threshold, suspends conveying of the medium.

8. An image forming apparatus comprising the device according to claim 7.

9. A device for conveying a medium, comprising:

the device according to claim 5; and a control unit that determines whether the skew amount exceeds the threshold, and when it is determined that the skew amount exceeds the threshold, conveys the medium to a predetermined position to evacuate the medium.

10. An image forming apparatus comprising the device according to claim 9.

11. A device for identifying a medium, comprising the device according to claim 1.

12. The device according to claim 11, further comprising:

a first storage unit that stores therein the true measured value;

a second storage unit that stores therein intensity information on an intensity of a transmitted light set in advance in association with a medium; and a determining unit that determines a type of the medium by comparing the true measured value stored in the first storage unit and the intensity information stored in the second storage unit.

13. The device according to claim 12, further comprising a medium-type setting unit that appropriately sets the intensity information for each type of the medium in the second storage unit.

14. The device according to claim 11, further comprising:

a storage unit that stores therein the true measured value; and a detecting unit that detects a multiple feed by comparing the true measured value stored in the storage unit with a true measured value for a subsequent medium obtained by the operating unit.

15. An image forming apparatus comprising the device according to claim 11.

16. An image forming apparatus comprising the device according to claim 1.

* * * * *